US006078130A

United States Patent [19]

Lepley

[11] Patent Number: 6,078,130

[45] Date of Patent: Jun. 20, 2000

[54] SPARK PLUG WITH SPECIFIC CONSTRUCTION TO AVOID UNWANTED SURFACE DISCHARGE

[75] Inventor: Joseph M. Lepley, Girard, Ohio

[73] Assignee: Altronic, Inc., Girard, Ohio

[21] Appl. No.: 09/189,211

[22] Filed: Nov. 10, 1998

Related U.S. Application Data

[60] Provisional application No. 60/064,982, Nov. 10, 1997.

[51] Int. Cl.[7] ..... H01T 13/20

[52] U.S. Cl. ..... 313/141; 313/130; 313/143

[58] Field of Search ..... 313/130, 137, 313/141, 142, 143

[56] References Cited

U.S. PATENT DOCUMENTS 4,939,409 7/1990 Friese et al. ..... 313/130

5,612,586 3/1997 Benedikt et al. ..... 313/141

*Primary Examiner*—Vip Patel

*Attorney, Agent, or Firm*—Webb Ziesenheim Logsdon Orkin & Hanson, P.C.

[57] ABSTRACT

A spark plug for an internal combustion engine comprises a tubular metal ground shell, a first electrode passing through the interior of the shell, a ceramic insulator sealing the space between the shell and the first electrode and a second electrode extending from the shell to define a gap with the first electrode. The ratio of effective distance along the surface of the ceramic defining the potential surface discharge path to the distance between the first and second electrodes being selected to prevent surface discharge as the spark gap erodes.

7 Claims, 8 Drawing Sheets

PROJECTED TIP SPARK PLUG

PROJECTED TIP SPARK PLUG

SPARK PLUG WITH SPECIFIC CONSTRUCTION TO AVOID UNWANTED SURFACE DISCHARGE

RELATED APPLICATION

This application claims the benefit of U.S. Provisional Patent Application No. 60/064,982, filed Nov. 10, 1997.

BACKGROUND OF THE INVENTION

It is generally assumed that the effective service life of spark plugs on any given engine is limited by the maximum voltage demand required to break down the spark gap between the electrodes and the ability of the ignition system used to deliver the required voltage to the spark plug. This invention is based on the discovery that for any given spark plug design for use in any given engine, the spark plug life is additionally limited by the maximum size of the electrode gap. This limitation is independent of the capability of the ignition system to deliver the required voltage. The service life of spark plugs is greatly extended by the means taught in this patent.

Experience has shown that the actual end of spark plug service life is often limited at a breakdown voltage well below the actual output capacity of the ignition system. This observed phenomena has generally been attributed to the limited dielectric capability of the components connecting the high voltage source to the spark plug. This problem has been so pervasive that the engine community has even created a specific term for this problem, "spark plug flash-over". In many cases where the end of life was occurring at low voltages relative to the capability of the ignition system, the dielectric limit of the connecting system may have been correctly identified as the root cause of the failure of the spark plug to initiate combustion within the cylinder of the engine. If an effort to eliminate this problem, spark plug manufacturers have increased external ceramic insulator lengths and ignition suppliers have developed better leads and wiring approaches. Some engine manufacturers have even gone to a coil on plug approach to reduce the distance traveled by the high voltage external to the spark plug to an absolute minimum. With all of these improvements and in spite of the fact that the external dielectric limit has been greatly extended by the use of these better wiring and insulation techniques, the proper operation of the spark ignited engine is still often limited to an in-cylinder voltage demand well below the ignition system capability. These observed engine misfire conditions are often incorrectly attributed to a lack of an electrical discharge event or to the assumed discharge through some path external to the spark plug, for example, a defective plug, wire, ignition coil or the like.

In reality, under engine misfire conditions with worn spark plugs, many times the electrical discharge does occur inside the combustion chamber although not between the spark plug electrodes where intended. In the case of the current spark plug designs, the cause of the engine misfire is often a surface spark discharge of the plug inside the power cylinder of the engine at the center electrode down the center electrode ceramic insulator to the grounded shell. This occurs on spark plugs not intended for surface discharge operation. This unintentional surface discharge is a most significant problem for two distinct reasons.

In the first case, even if the surface discharge occurs more or less normally with a spark duration roughly equivalent to the normal arc, the energy transfer to the air/fuel mixture is still terribly inefficient due to the decreased surface area of the spark in contact with the mixture and the loss of localized heating of the mixture to the cooler insulator surface, and far more likely to experience quenching of the infant flame kernel due to the loss of self-sustaining combustion heat to the insulator surface. This quenching phenomena is known to those skilled in the art of spark ignited engines. Surface gap spark plugs are specifically designed to overcome this problem.

The second phenomena has been to the best of my knowledge previously unidentified. Not only is the infant flame kernel subject to quenching by this surface contact, but also infant electrical sparks (arcing events) suffer from a similar problem. In the period immediately following the breakdown event, the arc is often observed to be momentarily interrupted (see FIG. 1) when the breakdown occurs at relatively high voltages (25 kV or more). This appears to occur regardless of the discharge path. However, dependent upon the actual discharge path, the results of the next event in the sequence are vastly different (see FIG. 2). When the arc is established normally through the gaseous media between the intended electrodes, the arc re-establishes itself almost immediately and with a very low second breakdown requirement (5 kV or less, see FIG. 2, trace A). When this occurs, the total energy transferred is not measurably different than a single spark event and has been treated by those skilled in the art as though it were a single event. When the discharge path is across the surface of the solid insulating material, the arc also seems to interrupt immediately after being established, however the breakdown voltage required to re-strike the arc is significantly higher than the previous case (see FIG. 2, trace B). This is because unlike the breakdown through the air/fuel mixture, which is rich in highly charged ions, the gas molecules in the boundary layer near the insulator are a poor donor of electrons and they are in short supply after the initial breakdown event. As a result, in the surface discharge case, the voltage demand of the re-strike may be nearly equal to or even greater than the original surface spark event (see FIG. 2, trace B greater than 20 kV). After the first surface discharge event, a large portion of the ignition system energy has been expended and the arc may not re-strike at all. Even if a re-strike or "arc continuation" does occur (see FIG. 5) due to this much higher additional or second breakdown requirement, a spark event of extremely short duration occurs and inadequate energy is transferred to the mixture to initiate normal combustion.

FIGS. 4, 5 and 6 show the impact on a typical used spark plug of an electrode erosion of only 0.004 inch upon the tendency of the spark to discharge via a surface route instead of between the intended electrodes. These figures show that the surface discharge occurs at an even lower voltage (less than 25 kV) than with a new plug and it also occurs with a much greater frequency. This is an important factor in the effective plug life since as the erosion occurs, the average voltage required for proper engine operation continuously increases.

SUMMARY OF THE INVENTION

The cause of the surface discharge phenomena is that the voltage required for breakdown across the surface of the center electrode insulator to the ground is less than that required for a breakdown between the electrodes. One cause of the problem is that the distance across the insulator surface is inadequate. In the past, the length of the insulator has been designed primarily based on the desired heat range of the spark plug with little or no consideration given to the potential problem of surface discharge. The testing which has been done to validate new designs has often been done only at the smallest of the standard gaps and low gas pressures. As the pressure of the gas mixture surrounding the spark plug is increased, the voltage required to break down the fuel/air mixture between the electrodes increases at a higher rate than the voltage required to break down the mixture along the surface of the insulator. This has resulted in increasingly poor spark plug life as the working pressures and voltage requirements of the spark plugs have increased. Modern engines operate at increasingly higher pressures on BMEP. This problem is compounded since higher engine BMEP generally leads to a colder plug design. A colder plug design leads to a shorter insulator inside the combustion chamber and increased potential for surface discharge down in the insulator. Additionally, the proximity of the insulator surface to the ground plane has been found to have an important effect. As the gap between the electrodes is increased to a distance equal to or greater than the distance of the insulator from the grounded shell, the onset of surface discharge events is assured.

Briefly, according to this invention, there is provided a spark plug for an internal combustion engine comprising a tubular metal casing or shell with external threads for being turned into the spark plug opening in the electrically grounded engine block, a first metal electrode passing through the interior of the tubular metal casing, a ceramic insulator sealing the space between the tubular metal casing and the electrode, a second electrode extending from the metal casing and being adjustable to define a gap with the first electrode, the ratio of effective distance along the surface of the ceramic insulator defining the potential surface discharge path to the distance between the first and second electrodes being selected to prevent surface discharge as the spark gap erodes. According to a preferred embodiment, the effective distance is selected based upon the rise time of the ignition pulse.

BRIEF DESCRIPTION OF THE DRAWINGS

Further features and other objects and advantages of the invention will become clear from the following detailed description made with reference to the drawings in which.

DESCRIPTION OF THE PREFERRED EMBODIMENTS

As a result of these observations, it is clear that for any particular materials to be used in the manufacture of a spark plug that a minimum ratio of the distance of the exposed insulating material surface subjected to the dielectric stress of the breakdown event to the distance of the intended maximum spark discharge path through the gaseous media can be established. This length requirement must include the effects of electrode erosion to ensure proper spark plug operation throughout the designed service life. By establishing the proper surface discharge path length, the long life plug operation at higher ignition voltages, ignition pressures and spark plug gaps will be made possible. By eliminating the undesirable surface discharge events, this concept will lead to a significant improvement in spark ignited engine performance which has previously been limited by this behavior of the current plug designs. Since the exact means of extending the intrinsic high voltage standoff capability of the electrode insulators may vary, several means will be described.

Figure 1:
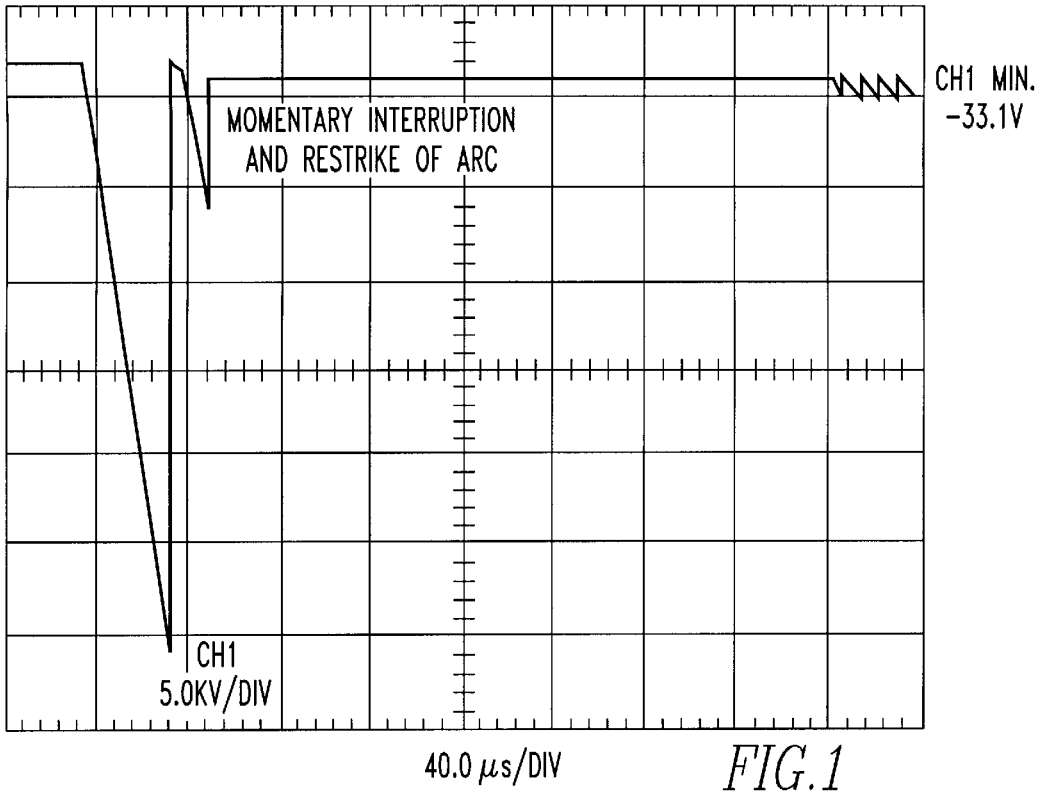
FIG. 1 is a waveform diagram of the voltage across the spark plug versus time illustrating the initial strike of the arc (at the bottom of the large downward peak) and the re-striking of the arc (at the bottom of the small downward peak) in a properly functioning spark plug.
Figure 2:
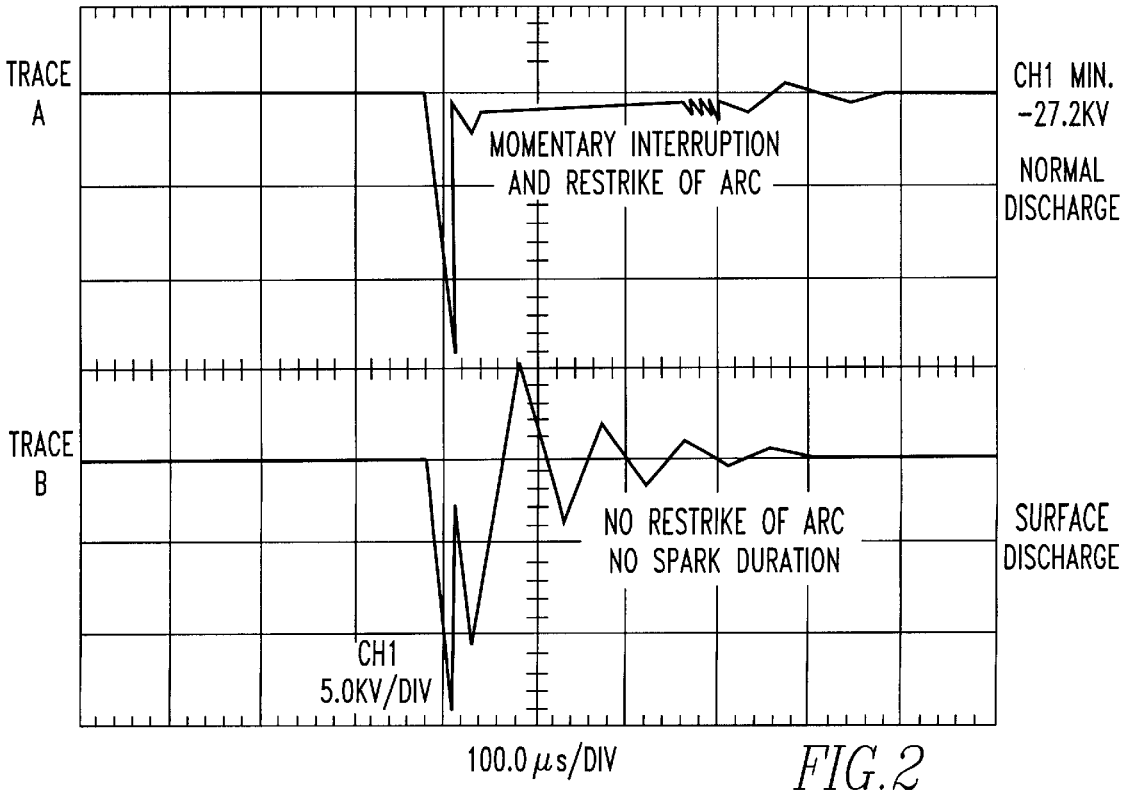
FIGS. 2 and 3 are waveform diagrams comparing the effect of normal discharge (trace A) versus surface discharge (trace B) in spark plugs.
Figure 3:
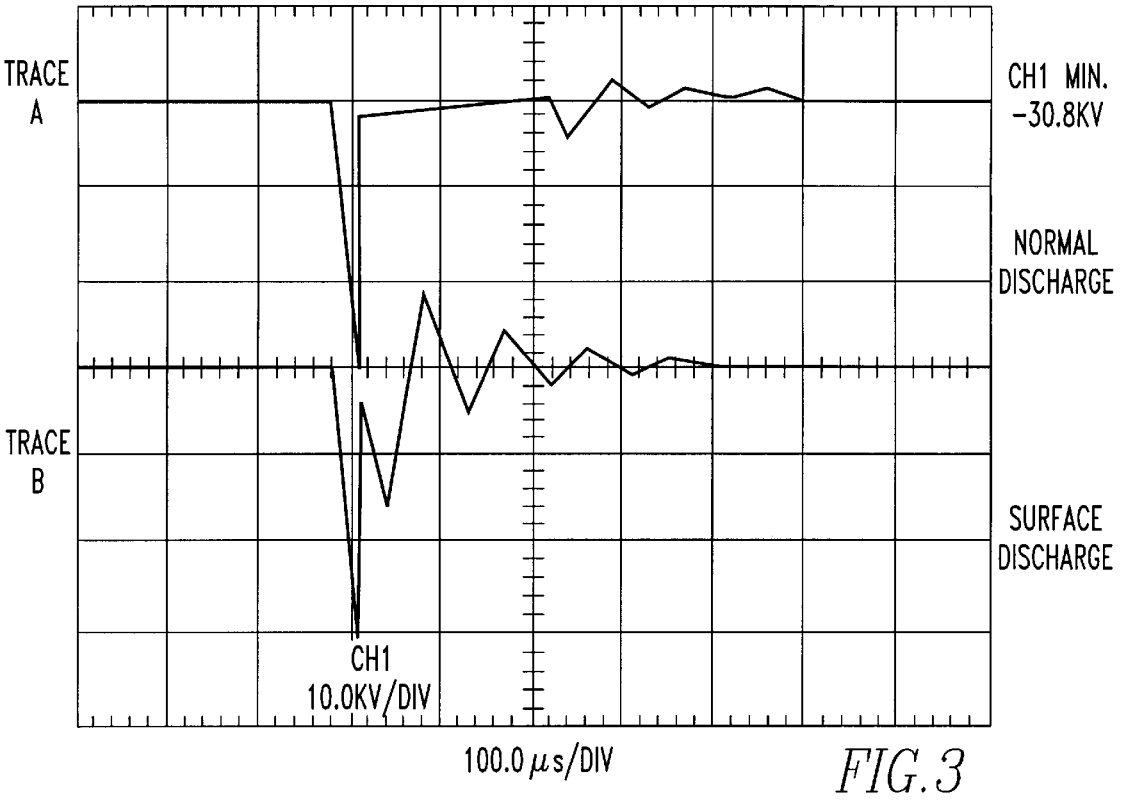
Figure 4:
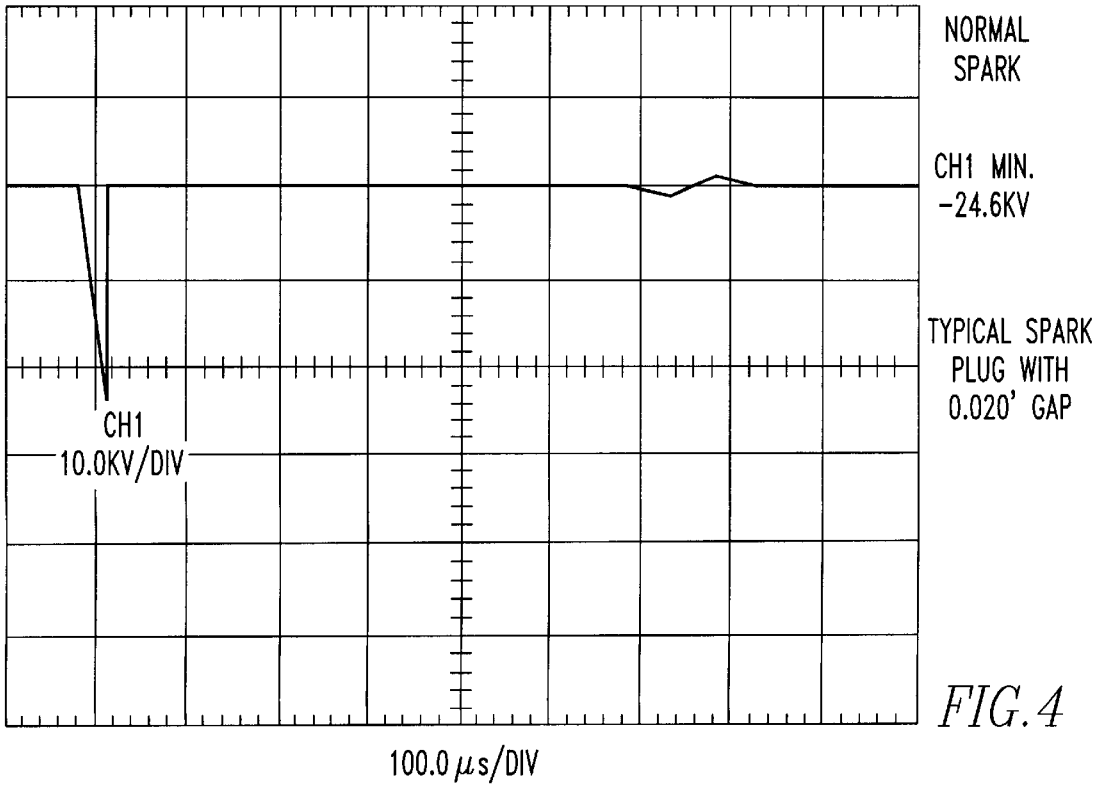
FIGS. 4, 5 and 6 are waveform diagrams showing the transition from arc discharge to surface discharge with re-strike to surface discharge without re-strike.
Figure 5:
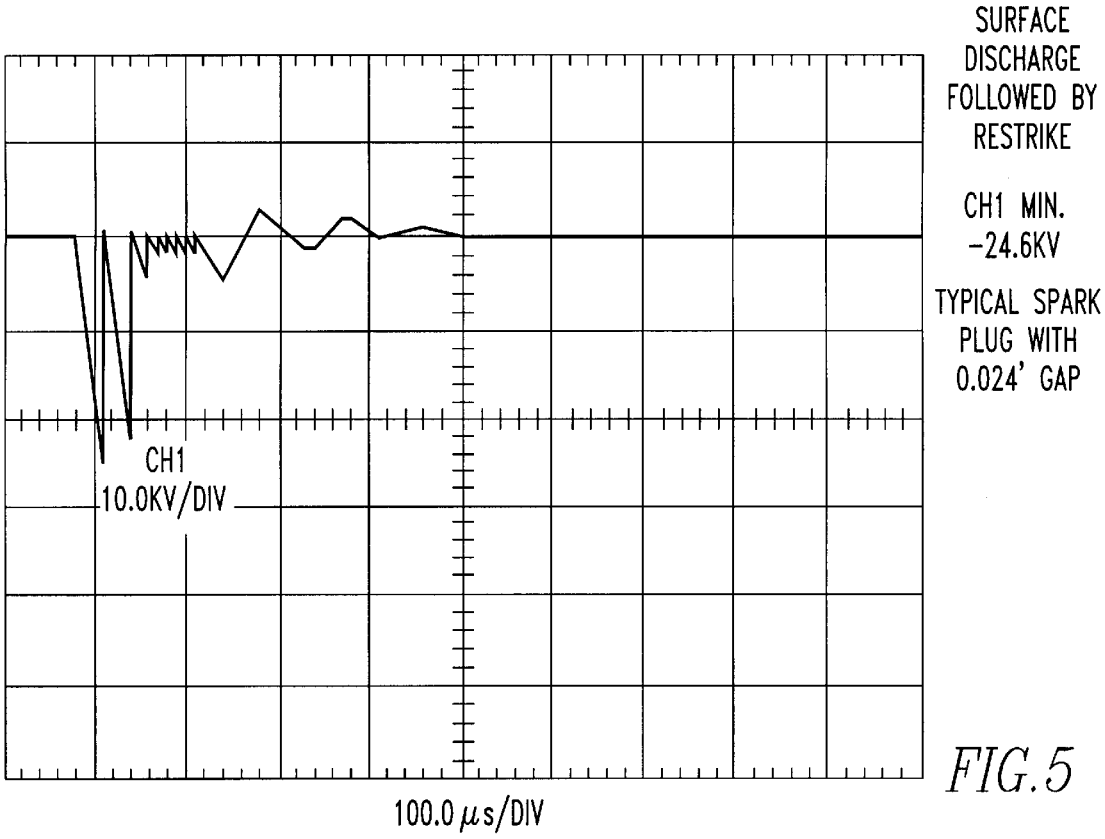
Figure 6:
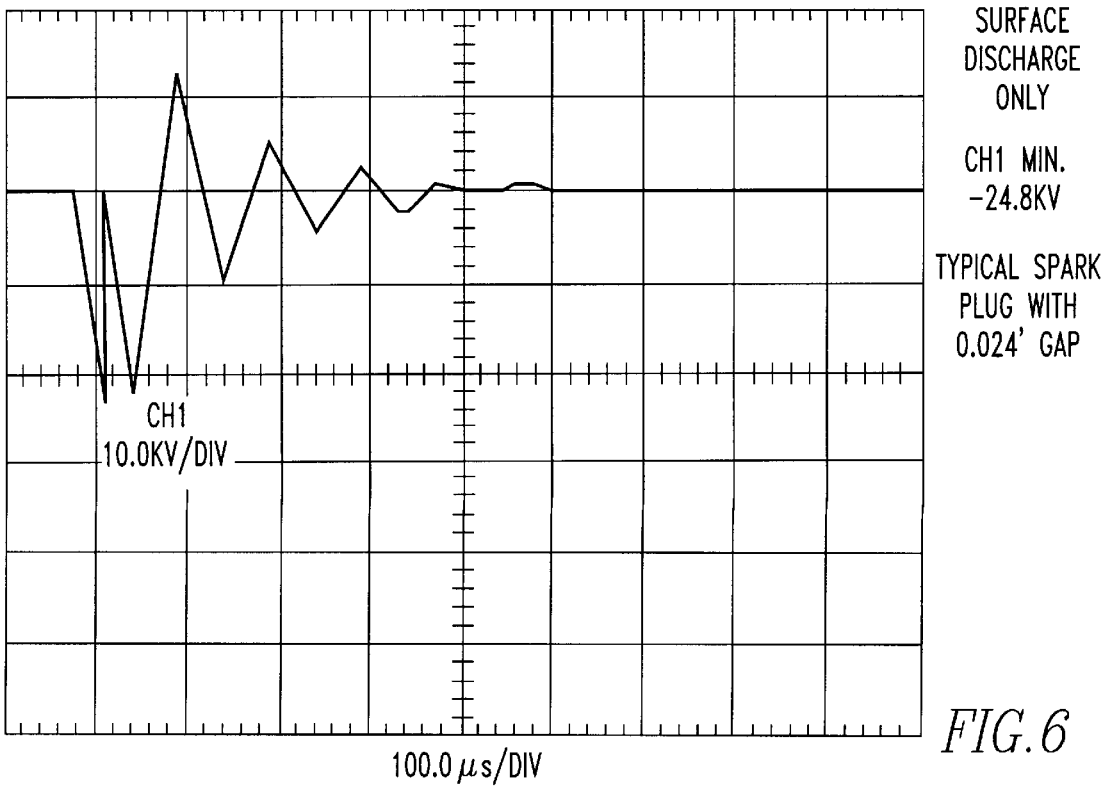
Figure 7:
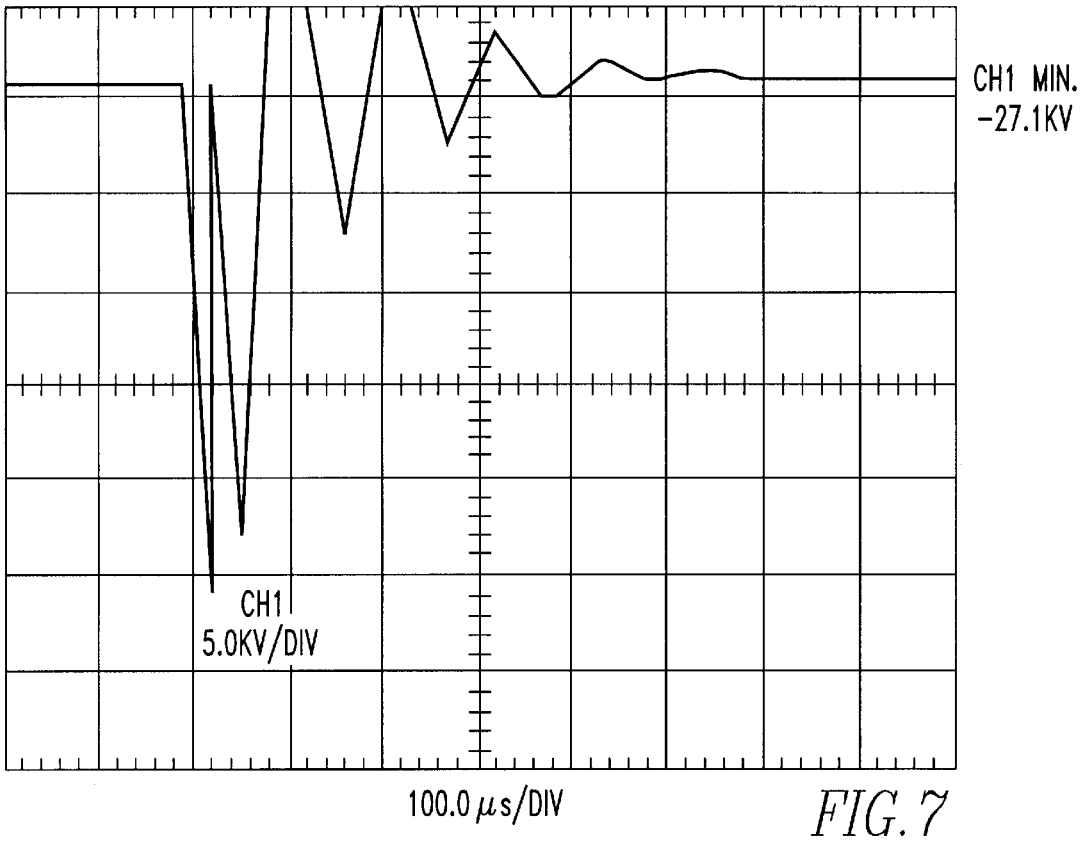
FIG. 7 is a waveform diagram of a spark plug demonstrating surface discharge without re-strike at voltages as low as 27 kV.
Figure 8:
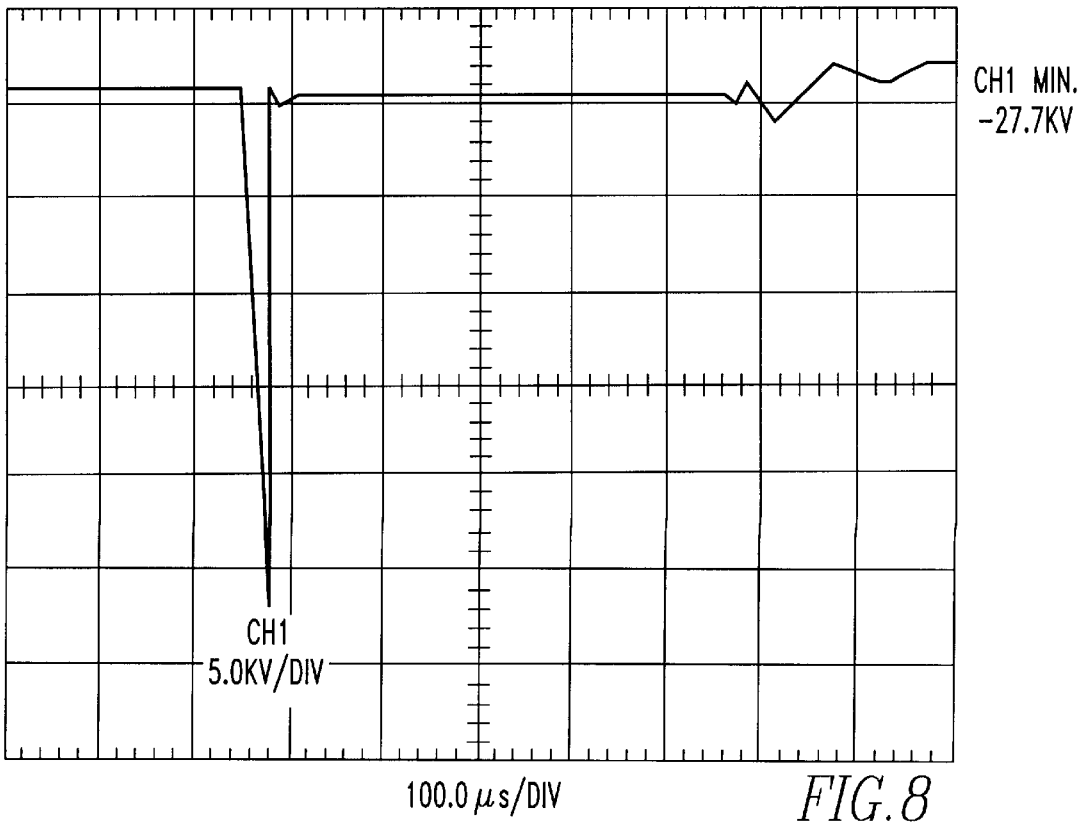
FIGS. 8, 9 and 10 are waveform diagrams that illustrate the same spark plug used for the waveform diagram of FIG. 7 but modified to perform correctly at 34 kV when driven with the same ignition system and coil.
Figure 9:
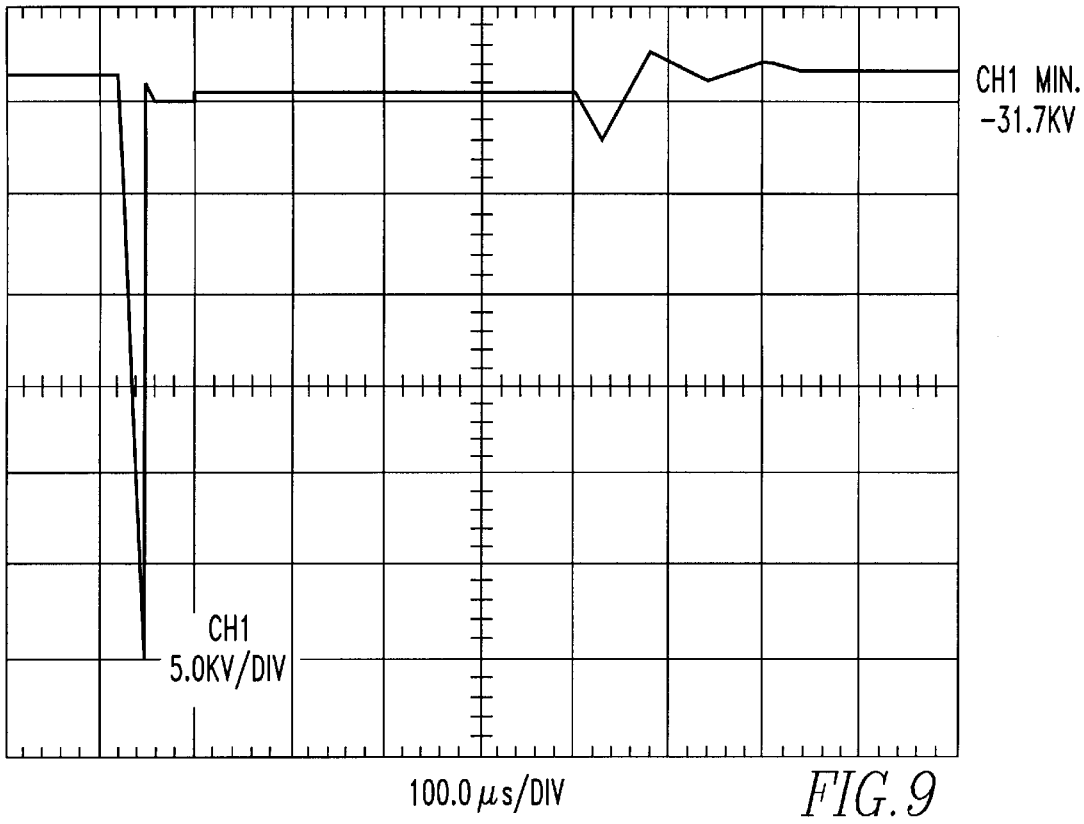
Figure 10:
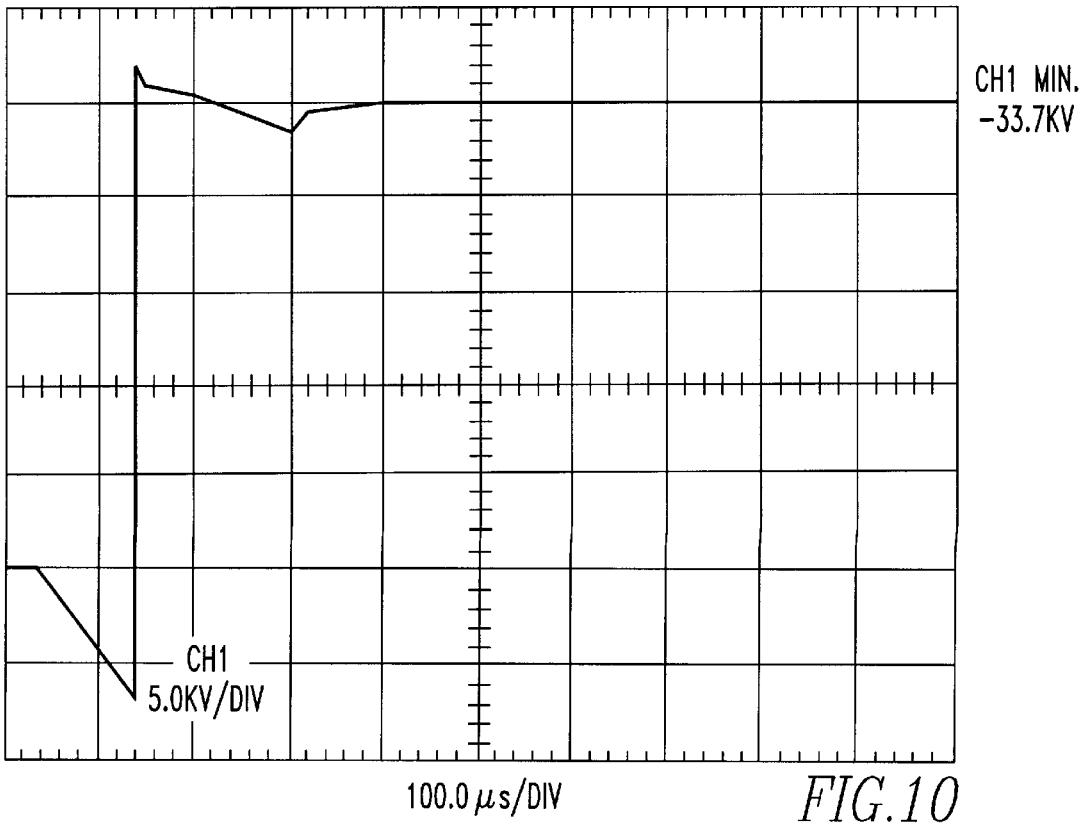
Figure 11:
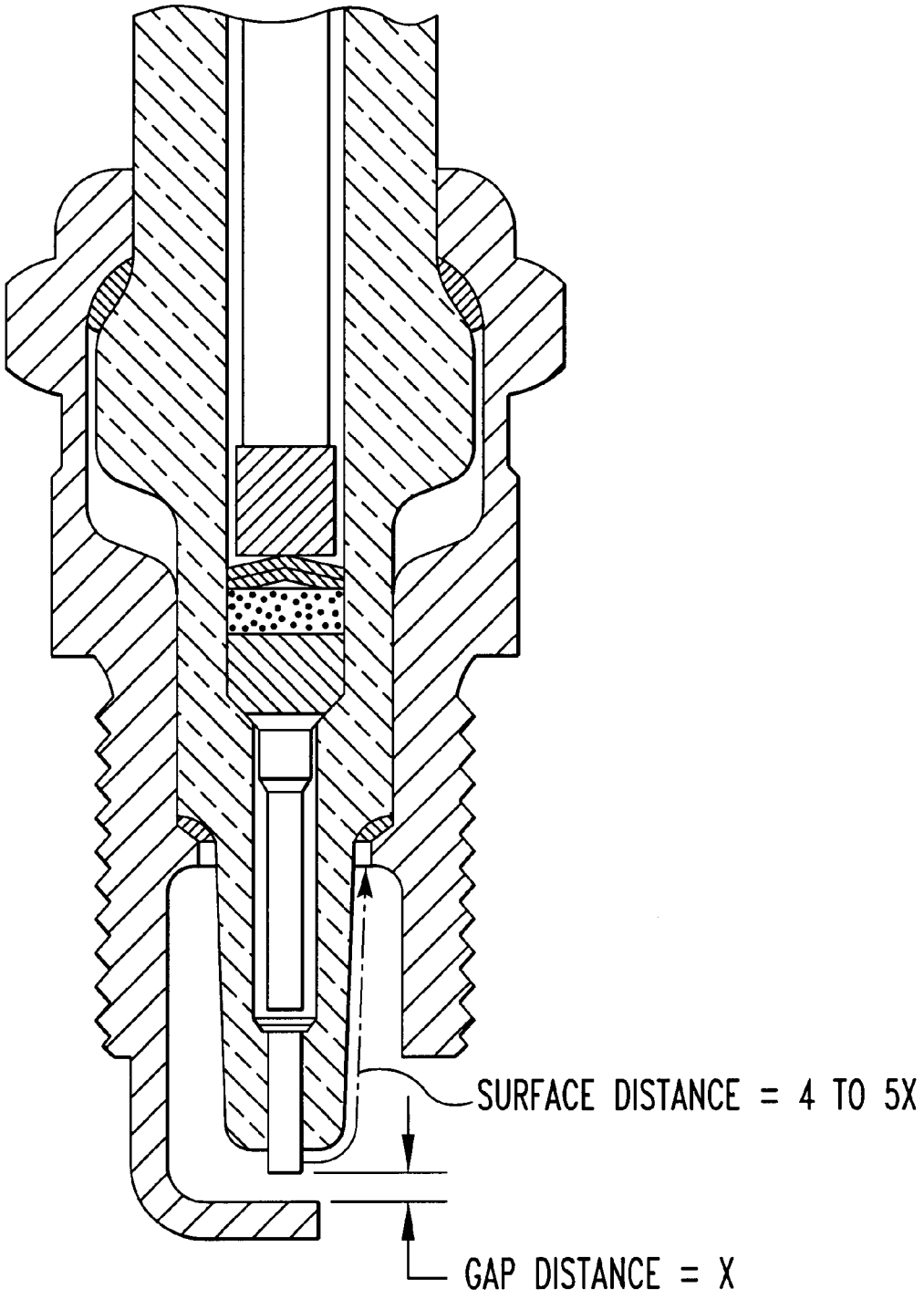
FIG. 11 is a section view of a spark plug according to one embodiment of this invention.

Referring to FIG. 11, in one embodiment, the ceramic insulator is lengthened to the distance required to avoid possible surface discharge events which is four to five times the maximum gap at the end of the spark plug life between the electrodes. In the past, the length of the insulator has been designed primarily based on the desired heat range of the spark plug with little or no consideration given to the potential problem of surface discharge. This has resulted in increasingly poor spark plug life as the working pressures and voltages of the spark plugs have increased. On projected insulator designs where a significant portion of the insulator nose extends beyond the grounded metal shell of the plug, this would be adequate in many cases.

Figure 12:
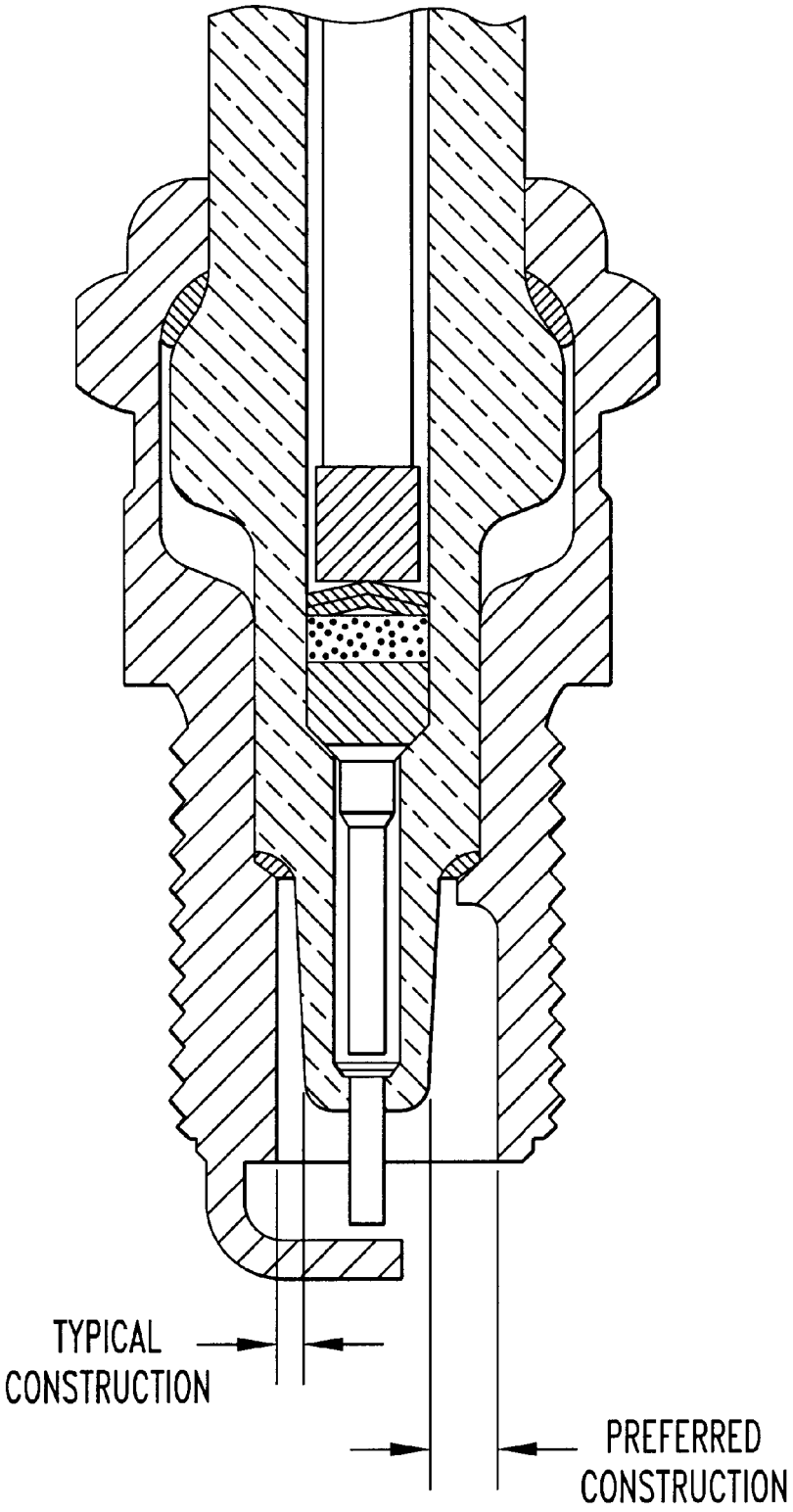
FIG. 12 is a section view illustrating on the right-hand side a preferred construction as compared with the left-hand side.

Referring to FIG. 12, on spark plugs where the insulator nose does not extend beyond the grounded metal shell of the plug body, this shell must be electrically isolated from the center electrode by either a gap significantly larger than the maximum electrode gap (two to three times) with which the plug must operate or by means of additional insulating material between the grounded shell and the center electrode insulator.

Figure 13:
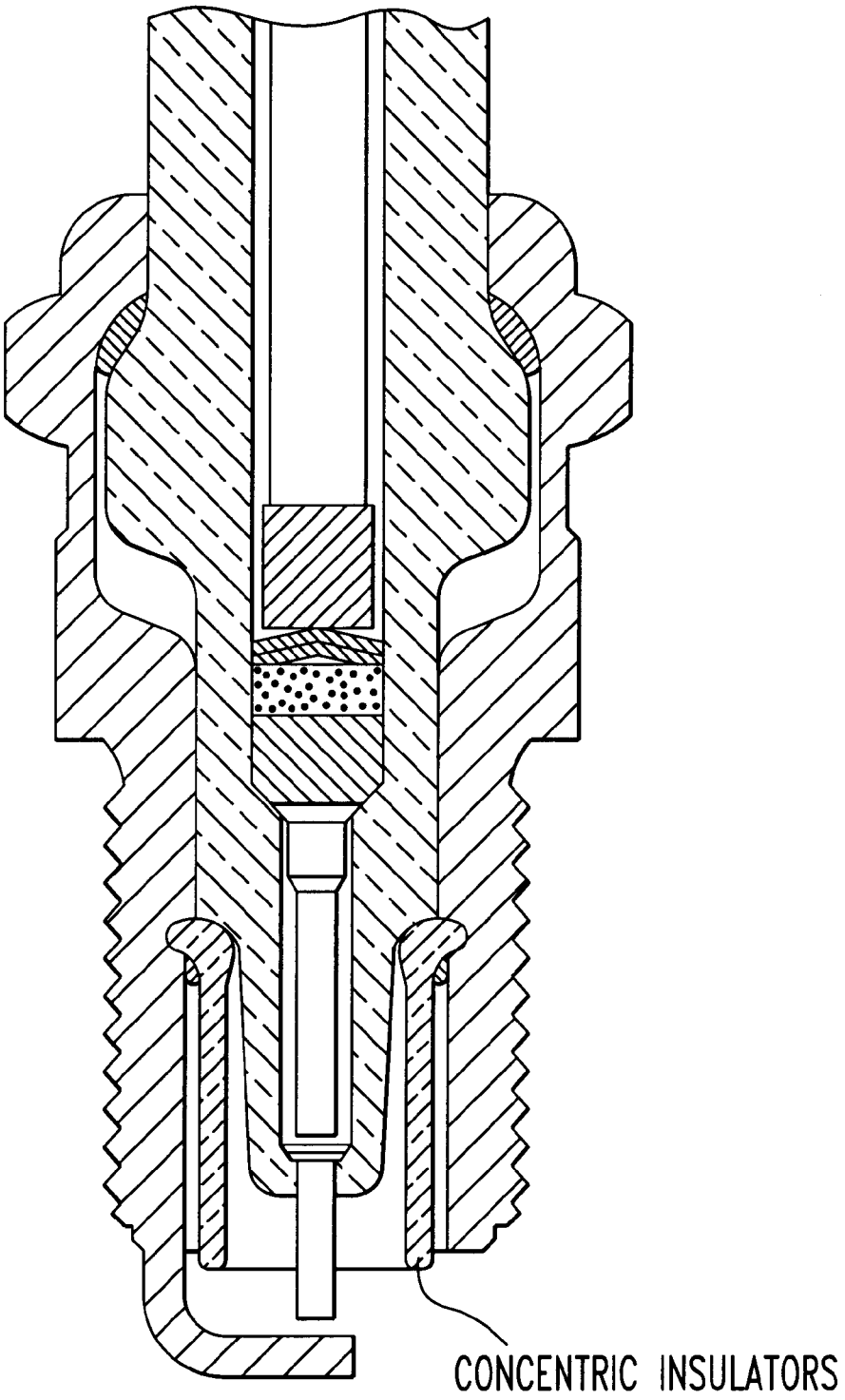
FIG. 13 is a section view of a spark plug according to an embodiment of this invention wherein an added insulating tube inhibits surface discharge.

Referring to FIG. 13, the effective distance across the surface of the spark plug insulator can be extended by the use of rippled or convoluted shapes. Additionally, the effective distance across the insulator surface can also be enhanced by the use of concentric tubular insulators surrounding the center electrode.

Referring to FIGS. 7, 8, 9 and 10, waveform patterns show the observed surface discharge phenomena and illustrate the solution. For experimental purposes, a silicone dielectric material was used to simulate the extended ceramic length in the cup-shaped embodiment, thus insulating the inside of the metal plug shell from the center electrode. As can be seen with FIG. 7, the results are dramatic as the original plug design suffered intermittent arcing due to the surface discharge phenomena at levels as low as 26 kV. The same plug modified to eliminate surface discharge using an auxiliary insulator performed correctly to nearly 34 kV (see FIGS. 8, 9 and 10) when driven by the same ignition system and coil.

Applicant's invention is based upon the discovery that for any given non-surface gap spark plug design for use in internal combustion engines, proper spark plug function and service life are electrode gap distance limited by any given in-cylinder gas mixture pressure, regardless of the ability of the ignition system to supply adequate voltage to produce a spark breakdown. This is due to the unwanted occurrence of a surface discharge prior to the desired spark discharge between the electrodes.

The applicant's invention is further based upon the discovery that a surface discharge spark can result in an event which initially appears to be a normal sparking event, but which is not followed by an arc of any measurable duration. Furthermore, this surface spark has a unique electrical signature ineffectual for initiating combustion in a spark ignited internal combustion engine.

The applicant's invention is still further based on the discovery that in internal combustion engines, for any given non-surface gap spark plug design, the voltage requirement for breakdown across the surface of the insulator increases at a lesser rate versus the in-cylinder gas mixture pressure than the voltage required to break down between the electrodes increases versus the in-cylinder gas mixture pressure resulting in an increasing occurrence of undesirable surface discharge for any given spark plug as in-cylinder gas mixture pressure is increased, thus limiting the operation of the given spark plug to a maximum gas mixture pressure at any given gap without regard to the voltage capability of the ignition system.

Applicant's invention is based on the discovery that for any given non-surface gap plug design, the voltage requirement for breakdown across the surface of the insulator remains constant at a fixed in-cylinder gas mixture pressure and that the voltage required to break down between the electrodes increases versus the distance between the electrodes at a fixed in-cylinder gas mixture pressure resulting in an increasing occurrence of surface discharge for any given spark plug as the electrode gap is increased, thus limiting the operation of the given spark plug to a maximum gap at any given gas mixture pressure without regard to the voltage capability of the ignition system.

Yet further, applicant's invention is based on the discovery that on non-surface gap spark plugs for use on internal combustion engines, as the distance between the electrodes through the in-cylinder gas mixture approaches the distance between the grounded metal shell and the center electrode insulator through the in-cylinder gas mixture that the distance over the surface of the insulator which is paralleled by the grounded metal shell is ineffective in eliminating surface discharge.

Having thus described my invention with the detail and particularity required by the Patent Laws, what is desired protected by Letters Patent is set forth in the following claims.

I claim:

1. A spark plug for an internal combustion engine, comprising:

a tubular metal casing with external threads for being turned into the spark plug opening in the engine block;

a first metal electrode passing through the interior of the tubular metal casing;

a ceramic insulator sealing the space between the tubular metal casing and the electrode; and a second electrode extending from the metal casing to define a spark gap with the first electrode, wherein an effective distance along a surface of the ceramic insulator defines a potential surface discharge path that is at least four times the distance of the spark gap.

2. The spark plug according to claim 1, wherein the surface discharge path excludes a surface of the ceramic insulator that is spaced from the uninsulated metal casing by a distance less than the spark gap.

3. The spark plug according to claim 1, further comprising an insulating material positioned between the ceramic insulator and the metal casing.

4. The spark plug according to claim 3, wherein the insulating material comprises a concentric insulating tube between the ceramic insulator and the metal casing.

5. The spark plug according to claim 1, wherein the ceramic insulator has a rippled or convoluted shape to extend the effective distance across the surface thereof.

6. The spark plug according to claim 1, wherein a ratio of the effective distance to the spark gap is selected to prevent surface discharge as the spark gap erodes.

7. The spark plug according to claim 6, wherein the ratio is selected to prevent surface discharge at the end of the projected service life of the spark plug.

* * * * *